US010323440B1

(12) United States Patent
Kelsch et al.

(10) Patent No.: US 10,323,440 B1
(45) Date of Patent: Jun. 18, 2019

(54) ANTI-THEFT DEVICE HAVING AN INTERLOCKING ASSEMBLY FOR SECURING AN ARTICLE OF MERCHANDISE

(71) Applicants: Christopher A. Kelsch, Palm Harbor, FL (US); Vanguard Products Group, Inc., Oldsmar, FL (US)

(72) Inventors: Christopher A. Kelsch, Palm Harbor, FL (US); John N. Figh, Jr., Oldsmar, FL (US); Matthew Kuntz, Tampa, FL (US); Lucas P. Swartwood, San Jose, CA (US); Wade Zhu, Westchase, FL (US); Volodymyr Andreev, Lviv (UA); Peter D. Iezzi, Coral Springs, FL (US); Andriy Los, Lviv (UA)

(73) Assignee: Vanguard Products Group, Inc., Oldsmar, FL (US)

( * ) Notice: Subject to any disclaimer, the term of this patent is extended or adjusted under 35 U.S.C. 154(b) by 0 days.

(21) Appl. No.: 16/105,673

(22) Filed: Aug. 20, 2018

(51) Int. Cl.
*E05B 73/00* (2006.01)
*E05B 47/00* (2006.01)

(52) U.S. Cl.
CPC ..... *E05B 73/0017* (2013.01); *E05B 47/0001* (2013.01); *E05B 73/0047* (2013.01); *E05B 73/00* (2013.01); *E05B 73/0082* (2013.01)

(58) Field of Classification Search
CPC .. E05B 73/00; E05B 73/0005; E05B 73/0011; E05B 73/0017; E05B 73/0023; E05B 73/0029; E05B 73/0047
See application file for complete search history.

(56) References Cited

U.S. PATENT DOCUMENTS

| | | | | |
|---|---|---|---|---|
| 7,522,048 | B2 * | 4/2009 | Belden, Jr. | E05B 73/0017 242/382 |
| 8,305,219 | B2 * | 11/2012 | Yang | G08B 13/1463 340/10.1 |
| 8,368,542 | B2 * | 2/2013 | Yang | G08B 13/1463 340/10.1 |
| 8,373,565 | B2 * | 2/2013 | Yang | G08B 13/2434 340/10.1 |
| 8,456,836 | B2 | 6/2013 | Allen et al. | |
| 9,169,670 | B2 * | 10/2015 | Shute | E05B 45/005 |
| 9,830,792 | B1 * | 11/2017 | Yang | G08B 13/2434 |
| 9,845,912 | B2 | 12/2017 | Phillips et al. | |
| 10,066,422 | B2 * | 9/2018 | Yang | E05B 73/0029 |
| 2014/0253290 | A1 * | 9/2014 | Yang | G06K 7/10188 340/10.1 |
| 2014/0366164 | A1 | 12/2014 | Hoefgen et al. | |

(Continued)

*Primary Examiner* — Christopher J Boswell
(74) *Attorney, Agent, or Firm* — Andriy Lytvyn; Smith & Hopen, P.A.

(57) ABSTRACT

An anti-theft device for securing an article of merchandise against unauthorized removal from a display counter. A clip securely holds the article of merchandise. The clip has a hook on a bottom surface thereof. A base has an aperture configured to receive the hook. When the hook is inserted into the base through the opening, the clip is shifted relative to the base such that the point of the hook resides underneath a top plate of the base. A locking member immobilizes the clip within the base preventing the hook from becoming realigned with the base. A key is used to retract the locking member to release the clip from the base.

19 Claims, 12 Drawing Sheets

(56) References Cited

U.S. PATENT DOCUMENTS

| | | | | |
|---|---|---|---|---|
| 2015/0302711 | A1* | 10/2015 | Yang | E05B 73/0029<br>340/572.9 |
| 2016/0356064 | A1* | 12/2016 | Ewing | E05B 73/0029 |
| 2018/0107248 | A1 | 4/2018 | Pischel et al. | |

* cited by examiner

ANTI-THEFT DEVICE HAVING AN INTERLOCKING ASSEMBLY FOR SECURING AN ARTICLE OF MERCHANDISE

BACKGROUND OF THE INVENTION

1. Field of the Invention

This invention relates to merchandise anti-theft devices. More specifically, it relates to an anti-theft device having an interlocking clip-base assembly for securing an article of merchandise.

2. Brief Description of the Related Art

Retailers often prefer to present their merchandise to consumers in a way that allows the consumers to touch, inspect, and otherwise interact with the products at a display counter. Many merchandise items, especially portable electronic devices, are relatively expensive and, therefore, are under a serious threat of theft. Retailers often face a dilemma of balancing a need to interactively display their merchandise to attract customers and increase sales, with a need to safeguard the merchandise against theft.

One type of anti-theft device for securing articles of merchandise involve clips having retention arms that secure an article of merchandise by grasping the opposite edges thereof. An example of such device is disclosed in a patent application entitled "Anti-Theft Device with Adjustable Locking Arms for Securing an Article of Merchandise" and having a Ser. No. 16/050,696. This type of security device is positioned behind the article of merchandise, thereby enabling customers to have full unobstructed access to the front face of the article of merchandise. However, to safeguard the article of merchandise against unauthorized removal from the retail store, the housing of the anti-theft device must be securely attached to a display counter.

Currently, a common solution for securing a clip holding the article of merchandise involves a pedestal mounted to the display counter and a tether cable connecting the clip to the pedestal. An example of such device is disclosed in the U.S. Pat. No. 8,698,618. Although tether cables enable the customer to remove the article of merchandise from the pedestal for a closer interaction, anti-theft devices relying on tether cables suffer from a serious flaw: a thief can cut the cable and steal the article of merchandise.

Thus, what is needed is an anti-theft device that enables secure interlocking between the pedestal mounted to the display counter and the housing coupled to the article of merchandise, thereby preventing unauthorized removal of the article of merchandise from the pedestal.

SUMMARY OF THE INVENTION

The longstanding and, heretofore, unmet need for an anti-theft device for providing a secure interlocking coupling between a clip holding an article of merchandise and a pedestal mounted onto a display counter is now met with a new and nonobvious device. An anti-theft device for securing an article of merchandise includes a clip having a top surface and a bottom surface. The top surface of the clip faces the article of merchandise when the article of merchandise is secured within the clip. On the bottom surface of the clip, there is at least one hook. The hook has a point and a gape, wherein the gape is a distance between the point of the hook and the bottom surface of the clip.

The anti-theft device further includes a base. The base has a top plate, the thickness of which is less than or equal to the gape of the hook. The top plate has at least one aperture configured to receive the hook.

A locking member is slidingly disposed within the base. The locking member has a first extended position, in which the locking member is proximal to the hook, and a second retracted position, in which the locking member is retracted away from the hook. The anti-theft device has a first locked configuration and a second unlocked configuration. In the first locked configuration, the clip is coupled to the base. The hook enters the base through the aperture, and, then, the clip is shifted with respect to the base, such that the hook and the aperture become misaligned. In the misaligned configuration, the point of the hook is positioned underneath the top plate. When the anti-theft device is locked, the locking member is in the first extended position, in which the locking member prevents the first hook from becoming realigned with the first aperture. Because the hook remains misaligned with respect to the first aperture, the hook cannot be removed from the base via the aperture. In this configuration, the anti-theft device is in the locked configuration and the clip is secured to the base.

In the unlocked configuration, the locking member is in the second retracted position, in which the locking member does not restrict the hook from realigning with the aperture. When the hook is realigned with the aperture, the first hook can exit therethrough, thereby releasing the clip from the base.

In an embodiment, a second hook is disposed on the bottom surface of the clip and a second aperture is disposed within the top plate of the base. The second aperture is configured to receive the second hook, whereby when a point of the second hook resides underneath the top plate, the clip is restricted against pivoting about the first hook.

In an embodiment, a biasing element is disposed within the base. The biasing element is configured to bias the locking member into the first extended position. In an embodiment, a key is used to transition the locking member from the first extended position into the second retracted position.

In an embodiment, a cam is rotationally disposed within the base. The cam engages the locking member, whereby rotation of the cam causes the locking member to transition from the first extended position into the second retracted position. In the embodiment in which the locking member is biased toward the extended position, a moment applied to the cam exceeds the biasing force that the biasing element exerts onto the locking member. In an embodiment, a key is used to rotate the cam within the base to retract the locking member.

In an embodiment, the first hook has a bend which is engaged by the locking member when the locking member transitions from the retracted position into the extended position. While transitioning from the retracted position to the extended position, the locking member exerts a force onto the bend. The force causes the point of the hook to slide underneath the top plate.

In an embodiment, the anti-theft device includes an electric motor that is used to retract the locking member.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Figure 1:
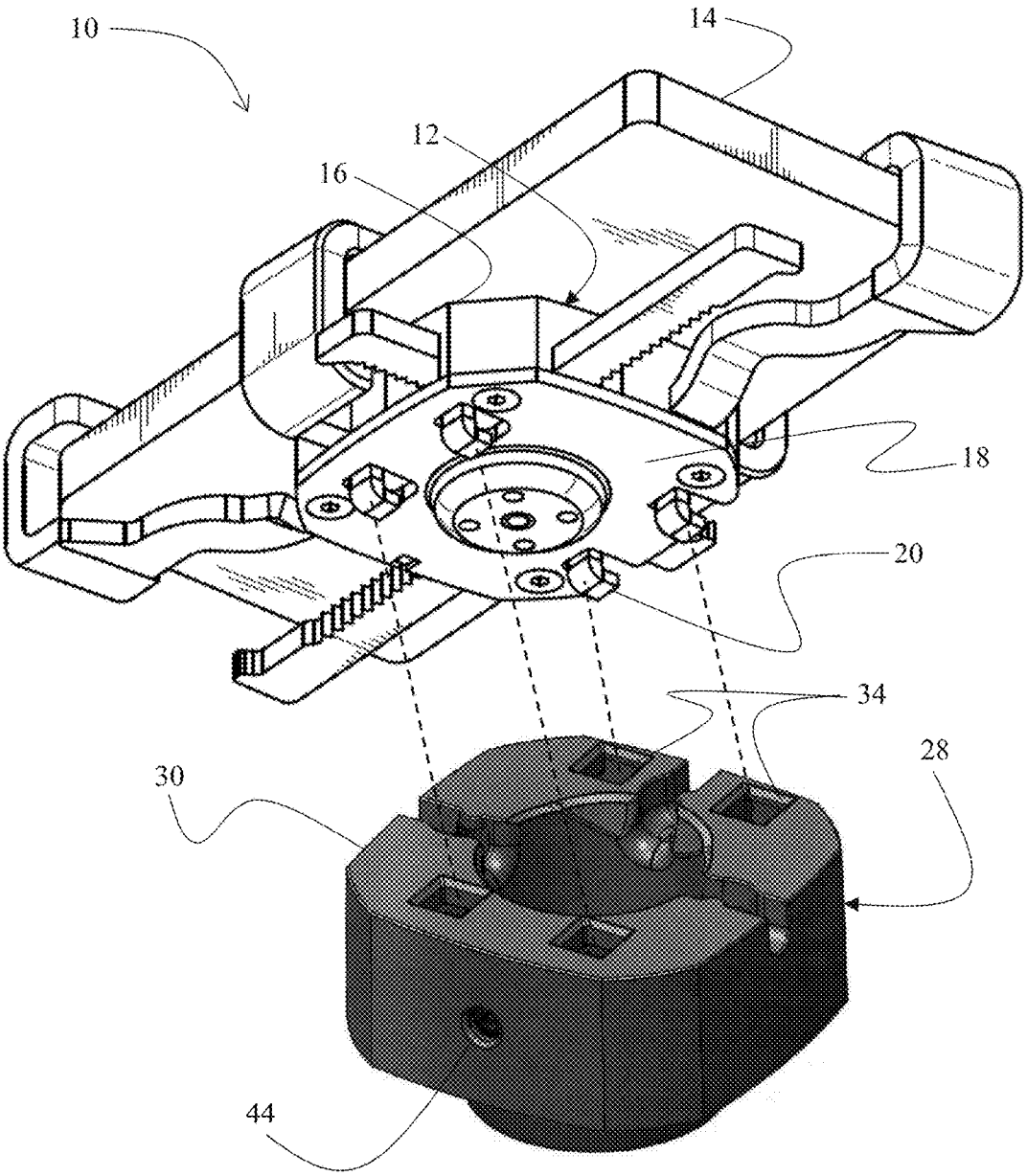
FIG. 1 is a perspective view of the anti-theft device.

FIG. 1 depicts a clip 12 securing therein an article of merchandise 14. A person skilled in the art will appreciate that the means of securing article of merchandise 14 within clip 12 depicted in FIG. 1 is merely exemplary, and that article of merchandise 14 can be secured to clip 12 using various means known in the art, including adhesive, fastening, mechanical gripping, magnets, etc., all of which fall within the scope of the invention.

FIG. 1 further depicts that clip 12 has a top surface 16 configured to couple to article of merchandise 14 or be in a closed proximity thereto when article of merchandise 14 is secured within clip 12. Clip 12 further has a bottom surface 18 opposite top surface 16. One or more hooks 20 are disposed on bottom surface 18 of clip 12.

FIG. 1 further depicts a base 28. Base 28 may be mounted directly to a display counter, may be a part of a pedestal mounted to a display counter, or may be otherwise securely deployed in a retail store. Base 28 has a top plate 30. One or more apertures 34 are disposed within top plate 30. Each aperture 34 is dimensioned to allow hook 20 to pass therethrough.

Figure 2A:
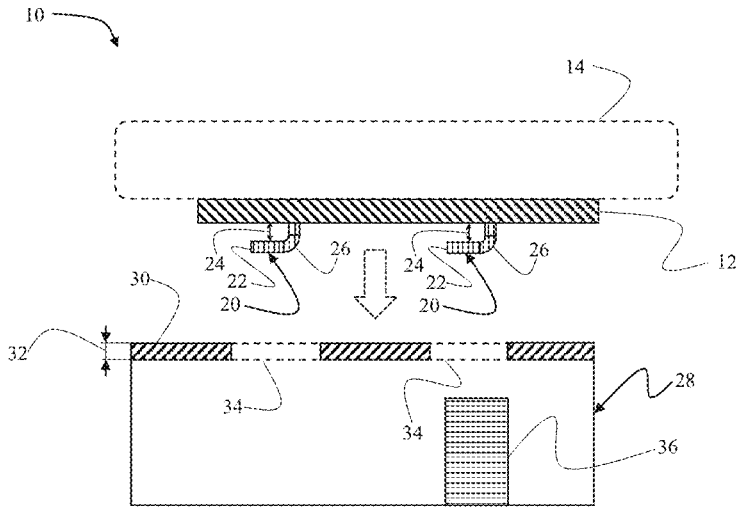
FIG. 2A is a schematic side view of the anti-theft device depicting an unlocked configuration of the anti-theft device, wherein the hooks of the clip are aligned with apertures of the base.
Figure 2B:
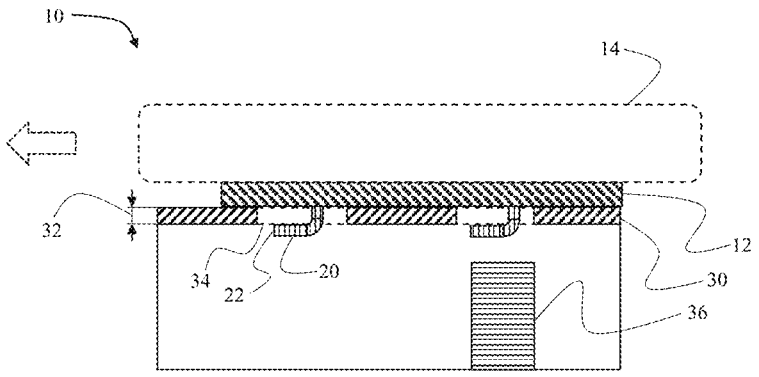
FIG. 2B is a schematic side view of the anti-theft device depicting the hooks of the clip positioned within the apertures of the base.
Figure 2C:
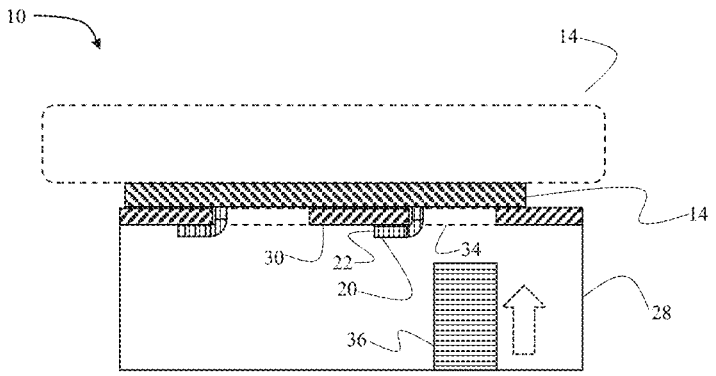
FIG. 2C is a schematic side view of the anti-theft device depicting the hooks of the clip being misaligned with the apertures of the base, with the points of the hooks being positioned underneath the top plate of the base.

As depicted in FIG. 2A, in the unlocked configuration clip 12 is detached from base 28, thus enabling a customer to hold and interact with article of merchandise 14. FIG. 2A depicts that each hook 20, has a point 22, a gape 24, and a bend 26. Gape 24 is a distance between point 22 and bottom surface 18 of clip 12. To secure clip 12 to base 28, the following steps are taken. First, as shown in FIG. 2A, clip 12 is positioned over base 28, such that hooks 20 align with apertures 32 of top plate 30. Second, as depicted in FIG. 2B, hooks 20 are inserted into base 28 via apertures 32. Thickness 32 of top plate 30 is equal to or less than gape 24 of hooks 20, which enables points 22 of hooks 20 to slide underneath top plate 30 as depicted in FIG. 2C.

Figure 2D:
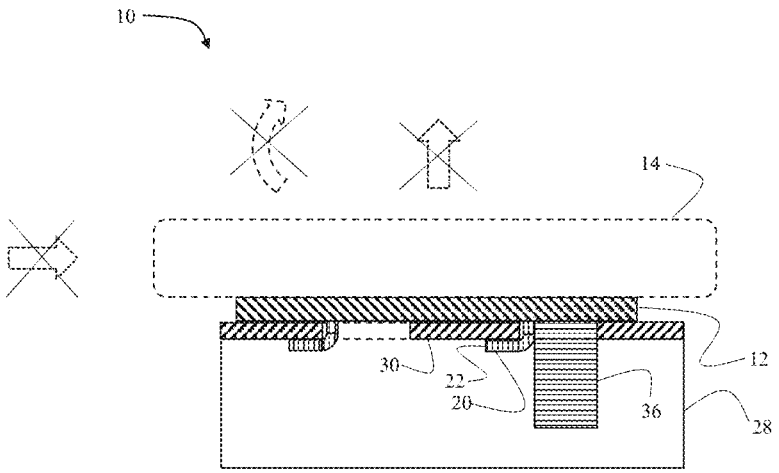
FIG. 2D is a schematic side view of the anti-theft device depicting the locked configuration of the anti-theft device, in which the locking member is in its extended position.

A locking member 36 is disposed within base 28. As shown in FIG. 2D, locking member 36 is configured to immobilize hooks 20 in the position in which points 22 reside underneath top plate 30. Locking member 36 prevents reverse translation of hooks 20, thereby preventing removal thereof via apertures 34. In this locked configuration, hooks 20 are immobilized underneath top plate 30 by locking member 36, thus securing clip 12 to base 28. Clip 12 and base 28 collectively form an interlocking assembly that enables secure display of article of merchandise 14. So long as locking member 36 remains in its extended position depicted in FIG. 2D, article of merchandise 14 cannot be lifted or otherwise detached from base 28.

In the embodiment of FIGS. 2A-E, clip 12 has multiple hooks 20, which secure clip 12 within base 28. By providing multiple points of connection between clip 12 and base 28, anti-theft device 10 is secured against removal attempts by pivoting clip 12 about any one hook 20 because the remaining hooks prevent any upward motion of any portion of clip 12. Also, in this embodiment, locking member 36 engages only one hook 20. This is sufficient to immobilize clip 12 against reverse translation and, therefore, is sufficient to secure clip 12 within base 28. In alternative embodiments, locking member 26 may be structured to engage multiple hooks 20, thereby further increasing security of anti-theft device 10 by providing redundancy. In some applications, a single hook 20 may suffice, which would lead to a simpler design and potential cost reduction. In other applications, it may be beneficial to have multiple hooks 20, some or all of which may be immobilized by locking member 36. In addition, some embodiments may have multiple separate locking members 36, each dedicated to immobilizing a specific hook 20 or hooks 20 within the respective apertures 32.

Figure 2E:
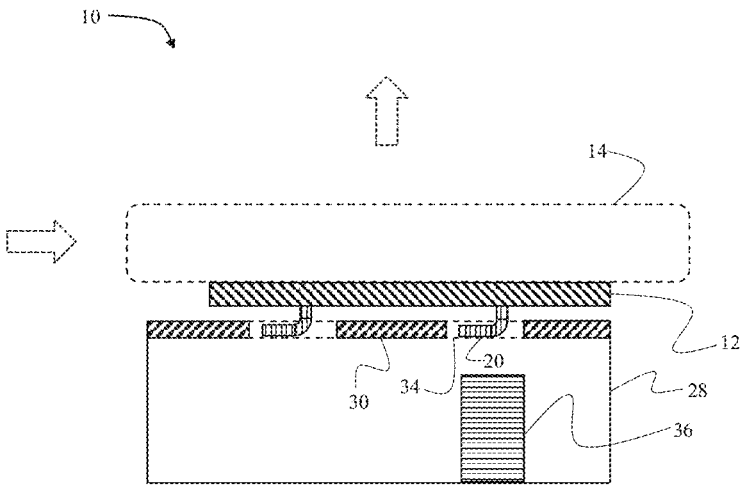
FIG. 2E is a schematic side view of the anti-theft device depicting an unlocked configuration of the anti-theft device, in which the locking member is in its retracted position.

To unlock anti-theft device 10, locking member 36 must be retracted away from hooks 20 as depicted in FIG. 2E. When locking member 36 is in its retracted position, hooks 20 can translate with respect to top plate 30 such that points 22 of hooks 20 can slide out from underneath top plate 30 and align with apertures 30. At this point, clip 12 can be lifted from base 28, as depicted in FIG. 2E, with hooks 20 exiting base 28 via apertures 30.

Figure 3A:
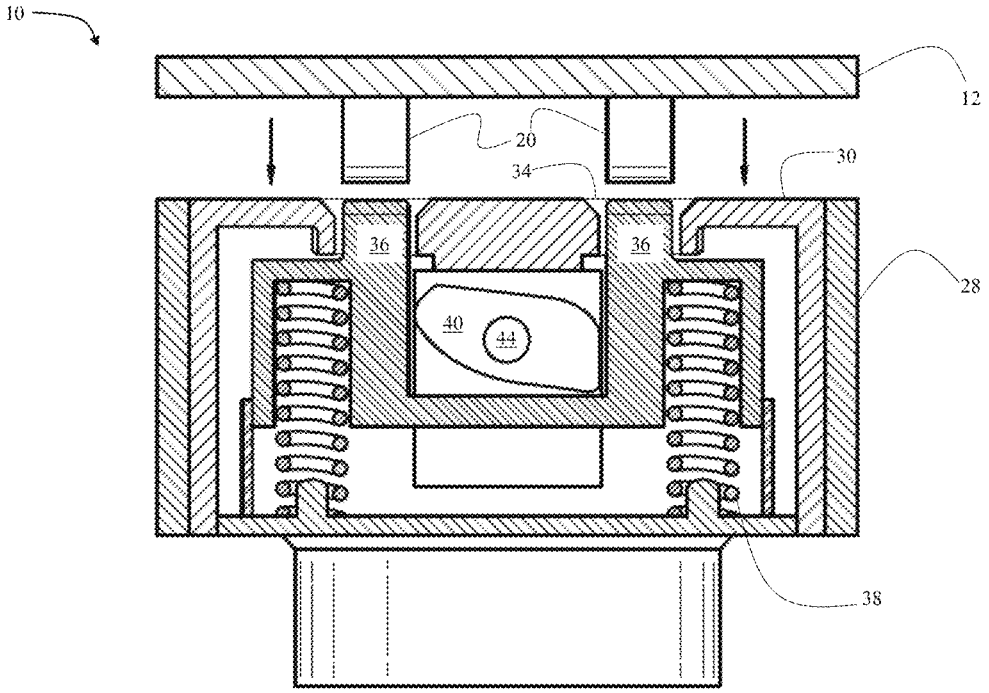
FIG. 3A is a front cutaway view of the anti-theft device depicting an unlocked configuration of the anti-theft device.
Figure 3B:
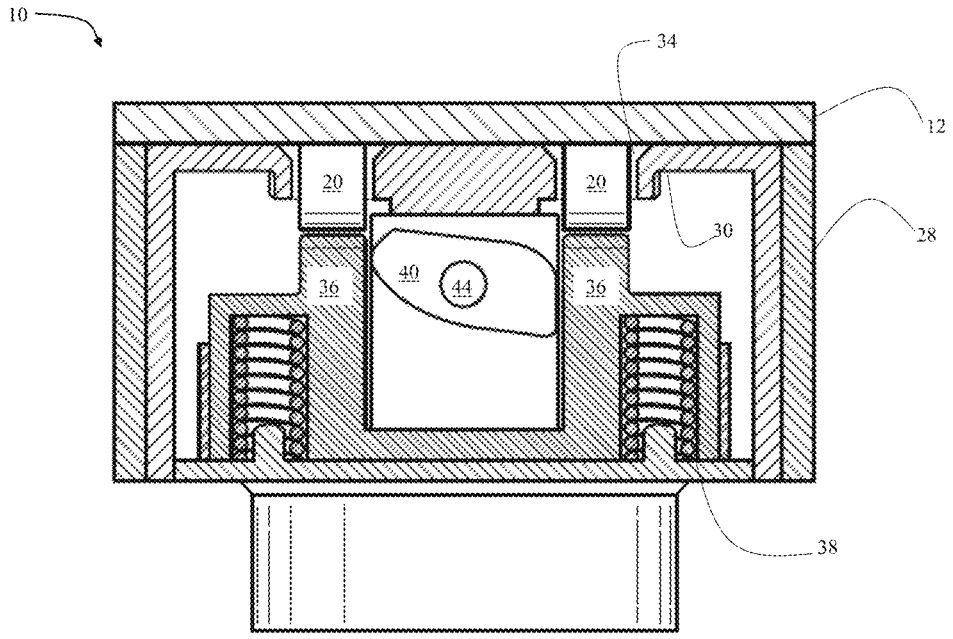
FIG. 3B is a front cutaway view of the anti-theft device depicting the hooks of the clip inserted into the apertures of the base, retracting the locking member against the biasing force exerted by the biasing element.

FIGS. 3A-F illustrate a method of securing an article of merchandise using anti-theft device 10. In this embodiment of anti-theft device 10, a biasing element 38 is disposed within base 28. Biasing element 38 urges locking member 36 into its extended position as depicted in FIG. 3A. To secure clip 12 to base 28, hooks 20 of clip 12 are aligned with apertures 30 within top plate 30 of base 28. When hooks 20 are in alignment with apertures 30, a downward force is applied onto clip 12. The downward force exceeds the biasing force exerted onto locking member 36 by biasing element 38, thereby retracting locking member 36 against the biasing force into its retracted position depicted in FIG. 3B. Once points 22 of hooks 20 translate downwardly by a distance exceeding thickness 32 of top plate 30, clip 12 can shift in a forward direction—i.e., in a direction parallel to the plane of top plate 30. As hooks 20 slide underneath top plate 30, they clear the path for locking member 36 to return to its extended position, into which it is being urged by biasing element 38. In an embodiment, the force causing hooks 20 to shift forward is supplied by biasing element 38. In this embodiment, locking member 24 engages bends 26 of hooks 20, wherein the slope of bends 26 causes the upward force exerted by locking member 36 onto bend 26 to have a forward force component that translates hooks 20 in a forward direction. In an alternative embodiment, the force needed to translate hooks 20 in a forward direction can be manually supplied by sliding clip 12 forward.

Figure 3C:
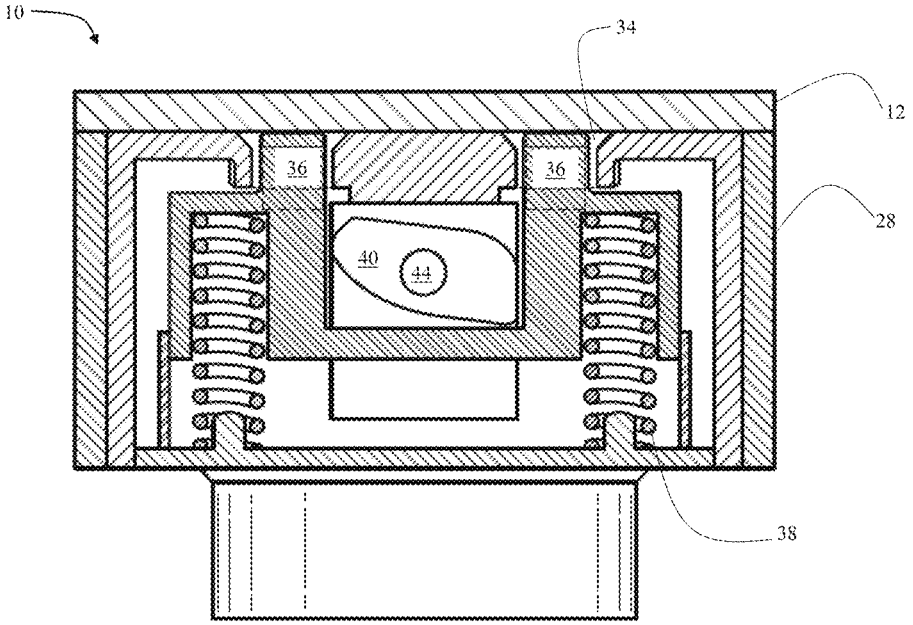
FIG. 3C is a front cutaway view of the anti-theft device depicting the locked configuration of the anti-theft device, in which the points of the hooks of the clip are positioned underneath the top plate and the locking member is in the extended position, in which the locking member immobilizes the hooks within the base.

Referring to FIG. 3C, when locking member 36 returns to its extended position, locking member 36 immobilizes hooks 20 against translating in a reverse direction. Thus, points 22 of hooks 20 remain underneath top plate 30, thereby interlocking clip 12 and base 28. This is the locked configuration of anti-theft device 10, in which article of merchandise 14 cannot be removed from base 28.

Figure 3D:
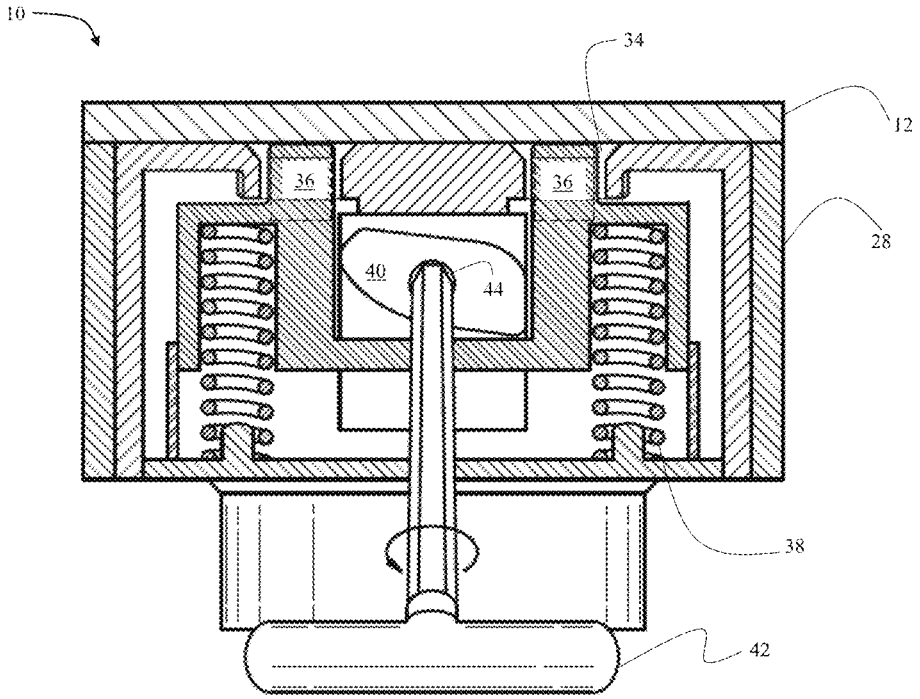
FIG. 3D is a front cutaway view of the anti-theft device depicting the locked configuration of the anti-theft device, with a key engaging the cam positioned within the base and a moment being applied onto the key to rotate the cam.
Figure 3E:
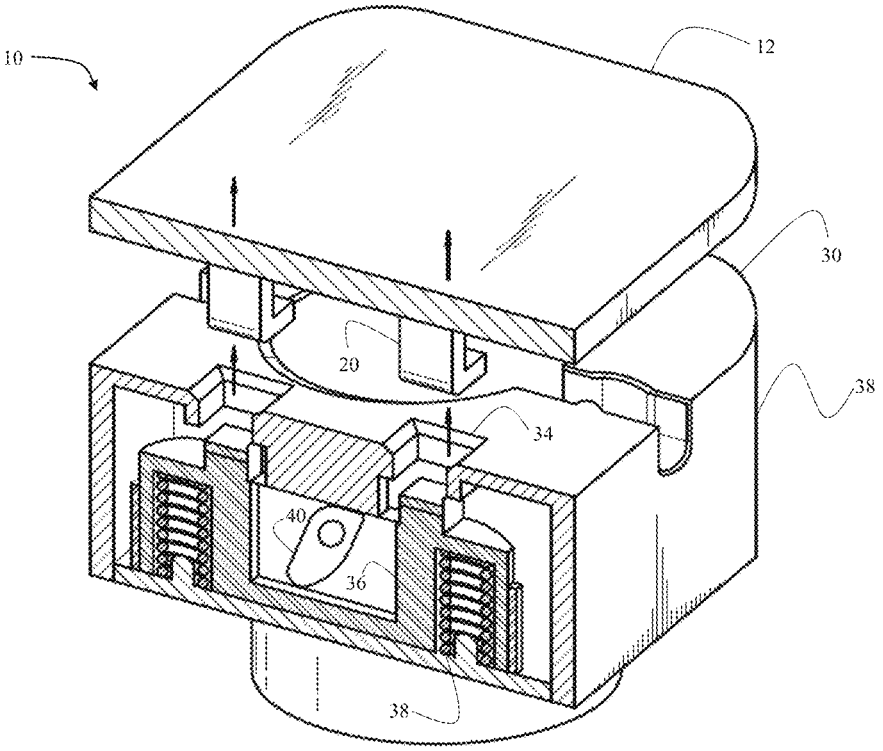
FIG. 3E is a perspective cutaway view of the anti-theft device depicting the unlocked configuration of the anti-theft device, in which the cam is rotated into a position in which it retracts the locking member away from the hooks.
Figure 3F:
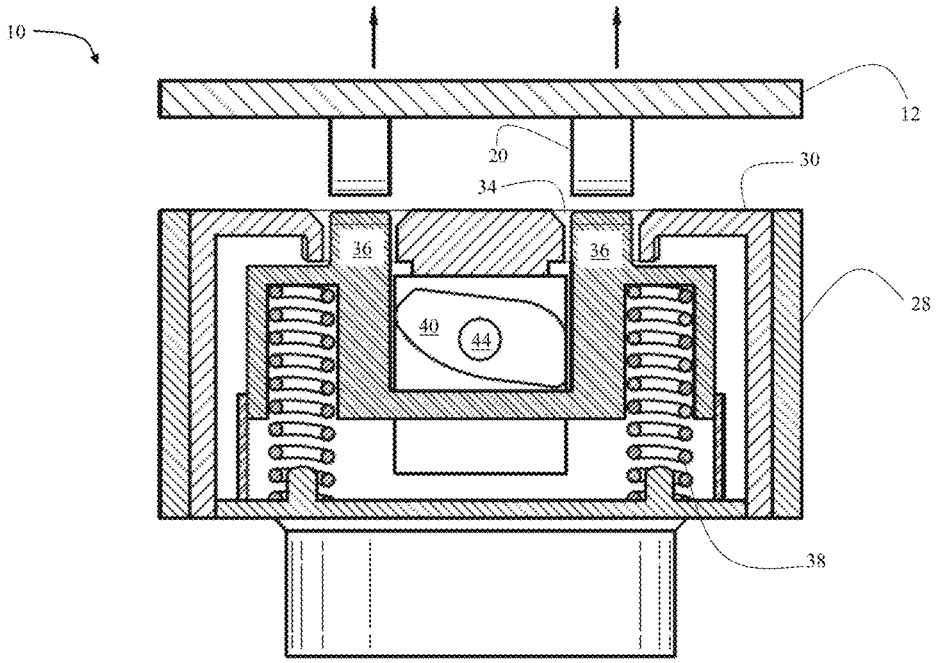
FIG. 3F is a front cutaway view of the anti-theft device depicting the unlocked configuration of the anti-theft device, with the clip being lifted away from the base.

The method of unlocking anti-theft device 10 is depicted in FIGS. 3D-F. To unlock anti-theft device 10, locking member 36 must be transitioned into its retracted position. In an embodiment, a cam 40 is rotationally disposed within base 28. In an embodiment, a key 42 is required to rotate cam 40 by engaging a corresponding socket 44 within cam 40. In alternative embodiments, electro-mechanical means—e.g., a motor—can be used to rotate cam 40. Such motor can be actuated remotely via an electric, radio, audio, or light signal or may have a mechanical actuation button. Yet, in other embodiments, cam 40 may be foregone and replaced with an electro-mechanical assembly configured to retract locking member 36.

Referring to FIG. 3D, cam 40 is concealed within base 28. Base 28 includes an opening to allow insertion of key 42 therein. This opening aligns with socket 44, thereby enabling the head of key 42 to engage socket 44. A moment applied onto key 42 is translated to cam 40. The moment must exceed the biasing force exerted onto locking member 36 by biasing element 38 to retract locking member 36 against the biasing force. Rotation of cam 40 causes cam 40 to apply a force onto locking member 36 that opposes biasing force biasing element 38 exerts onto locking member 36, thereby transitioning locking member 36 into its retracted position depicted in FIG. 3E.

FIGS. 3E-F depict the unlocked configuration of anti-theft device 10. When locking member 36 is retracted away from hooks 20, clip 12 can translate in a reverse direction, such that points 22 of hooks 20 slide out from underneath top plate 30. When hooks 20 become realigned with apertures 32 of top plate 30, clip 12 can be lifted out of base 28, wherein hooks 20 exit base 28 via apertures 32. Biasing force exerted onto locking member 36 by biasing element 38 returns locking member 36 its extended position after key 42 and hooks 20 are removed from base 28.

With clip 12 detached from base 28, a customer can hold article of merchandise 14 in his or her hands. In this manner, anti-theft device 10 provides a full interactive experience with article of merchandise 14 under supervision of authorized personnel member who unlocked anti-theft device 10. After the customer ceases his or her interaction with article of merchandise 14, the authorized personnel member replaces clip 12 onto base 30 such that hooks 20 align with apertures 32 and performs the steps depicted in FIGS. 3A-C to lock clip 12 to base 28. Because only authorized personnel have access to key 42, anti-theft device cannot be unlocked without seeking permission from the authorized personnel. Thus, customers can interact with article of merchandise 14 while it is secured to base 28—however, if they desire to hold article of merchandise 14, they must engage an authorized personnel member, who will then unlock anti-theft device 10 and will supervise the customer's interaction with article of merchandise 14.

As explained earlier, in alternative embodiments of anti-theft device 10, electro-mechanical mechanism can be deployed within base 28 to retract locking member 36. In those embodiments, only the authorized personnel will have access to the actuation means required to actuate the electro-mechanical mechanism. In this embodiments, a level of security is achieved by requiring customers to seek permission from the authorized store personnel to interact with article of merchandise 14.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. An anti-theft device for securing an article of merchandise, comprising:

a clip having a top surface and a bottom surface, the top surface facing the article of merchandise when the article of merchandise is secured within the clip;

a first hook disposed on the bottom surface of the clip, the first hook having a point and a gape, wherein the gape is a distance between the point and the bottom surface of the clip;

a base having a top plate, the top plate having a thickness, wherein the thickness of the top plate is less than or equal to the gape of the first hook;

a first aperture disposed within the top plate, the first aperture configured to receive the first hook, the clip having a first aligned position and a second misaligned position relative to the base, wherein in the first aligned position the first hook is able to enter and exit the first aperture, and wherein in the second misaligned position the point of the hook resides underneath the top plate and the first hook is unable to exit the base via the first aperture;

a locking member slidingly disposed within the base, the locking member having a first extended position and a second retracted position, in which the locking member is retracted away from the first hook; and wherein the anti-theft device has a first locked configuration and a second unlocked configuration, in the first locked configuration, the clip is coupled to the base and is in the second misaligned position and the locking member is in the first extended position such that the locking member prevents the clip from changing alignment relative to the base, from the second misaligned position into the first aligned position, thus immobilizing the first hook within the base, thereby securing the clip to the base.

2. The anti-theft device of claim 1, further comprising a second hook disposed on the bottom surface of the clip and a second aperture disposed within the top plate of the base, the second aperture configured to receive the second hook, thereby securing the clip against pivoting about the first hook.

3. The anti-theft device of claim 1, further comprising a biasing element disposed within the base, the biasing element configured to bias the locking member into the first extended position.

4. The anti-theft device of claim 1, wherein a key is required to transition the locking member from the first extended position into the second retracted position.

5. The anti-theft device of claim 1, further comprising a cam rotationally disposed within the base, whereby rotation of the cam causes the locking member to transition from the first extended position into the second retracted position.

6. The anti-theft device of claim 5, wherein a key is used to rotate the cam within the base.

7. The anti-theft device of claim 1, wherein the first hook has a bend and the locking member exerts a force onto the bend when the locking member transitions from the second retracted position into the first extended position, whereby the force causes the point of the first hook to slide underneath the top plate.

8. The anti-theft device of claim 1, further comprising an electric motor being used to retract the locking member into a second retracted position.

9. The anti-theft device of claim 1, wherein in the second extended position, the locking member partially occludes the first aperture.

10. A method of securing an article of merchandise using an anti-theft device, comprising:

securing the article of merchandise to a clip, the clip having a top surface and a bottom surface, the top surface facing the article of merchandise, the clip having a first hook disposed on the bottom surface thereof, the first hook having a point and a gape, wherein the gape is a distance between the point and the bottom surface of the clip;

placing the clip over a base, the base having a top plate, the top plate having a thickness, wherein the thickness of the top plate is less than or equal to the gape of the first hook;

aligning the first hook of the clip with a first aperture disposed within the top plate of the base, the first aperture configured to receive the first hook;

applying a force urging the first hook to into the first aperture, wherein after the first hook is inserted into the base via the first aperture, the clip is shifted with respect to the base such that the first hook becomes misaligned with the first opening, with the point of the hook being positioned underneath the top plate of the base;

wherein a locking member is disposed within the base, the locking member having a first extended position in which the locking member immobilizes the clip against movement with respect to the base, thereby restricting the first hook from becoming realigned with the first opening, thus restraining the first hook from exiting therethrough and securing the clip to the base.

11. The method of claim 10, wherein unlocking the anti-theft device comprises the step of retracting the locking member into a second retracted position such that the clip can be shifted with respect to the base into a position in which the first hook realigns with first aperture, thereby enabling removal of the clip from the base.

12. The method of claim 10, wherein the clip has a second hook disposed on the bottom surface thereof, and the base has a second aperture disposed within the top plate, the second aperture configured to receive the second hook, whereby the second hook restricts the clip against pivoting about the first hook.

13. The method of claim 10, wherein a biasing element is disposed within the base, the biasing element configured to bias the locking member into the first extended position.

14. The method of claim 13, wherein a key is used to retract the locking member against the biasing force exerted onto the locking member by the biasing element, thus transitioning the locking member from the first extended position into a second retracted position.

15. The method of claim 10, wherein a cam is rotationally disposed within the base, whereby rotation of the cam causes the locking member to retract from the first extended position into a second retracted position.

16. The anti-theft device of claim 15, wherein a key is used to rotate the cam within the base.

17. The method of claim 10, wherein the first hook has a bend and the locking member exerts a force onto the bend when the locking member transitions from the second retracted position into a first extended position, whereby the force causes the point of the first hook to slide underneath the top plate.

18. The method of claim 10, wherein an electric motor is used to retract the locking member into a second retracted position.

19. The method of claim 10, wherein in the second extended position, the locking member partially occludes the first aperture.

* * * * *